United States Patent [19]

Moriya

[11] Patent Number: 4,662,323

[45] Date of Patent: May 5, 1987

[54] OVERHEAD CAM TYPE VALVE ACTUATING APPARATUS FOR INTERNAL COMBUSTION ENGINE

[75] Inventor: Takashi Moriya, Saitama, Japan

[73] Assignee: Honda Giken Kogyo Kabushiki Kaisha, Tokyo, Japan

[21] Appl. No.: 728,260

[22] Filed: Apr. 29, 1985

[30] Foreign Application Priority Data

May 1, 1984 [JP] Japan ..... 59-64671[U]

[51] Int. Cl.[4] ..... F01L 1/26

[52] U.S. Cl. ..... 123/90.23; 123/90.4; 123/90.27; 123/90.44; 123/90.36

[58] Field of Search ..... 123/90.27, 90.36, 90.4, 123/90.22, 90.23, 90.44

[56] References Cited

U.S. PATENT DOCUMENTS

| | | | |
|---|---|---|---|
| 1,411,208 | 3/1922 | Elliott et al. | 123/90.22 |
| 1,415,167 | 5/1922 | Fuchs | 123/90.27 |
| 2,322,173 | 6/1943 | Spencer | 123/90.36 |
| 3,021,826 | 2/1962 | De Fezzy et al. | 123/90.36 |
| 3,628,513 | 12/1971 | Grosseau | 123/90.36 |
| 4,267,811 | 5/1981 | Springer | 123/90.27 |
| 4,363,300 | 12/1982 | Honda | 123/90.27 |
| 4,553,515 | 11/1985 | King et al. | 123/90.4 |
| 4,556,025 | 12/1985 | Morita | 123/90.16 |

FOREIGN PATENT DOCUMENTS

| | | | |
|---|---|---|---|
| 43228 | 3/1980 | Japan | 123/90.27 |
| 102506 | 6/1982 | Japan | 123/90.27 |
| 165613 | 10/1982 | Japan | 123/90.27 |
| 123658 | 3/1919 | United Kingdom . | |
| 674180 | 6/1952 | United Kingdom . | |

*Primary Examiner*—Ira S. Lazarus

*Attorney, Agent, or Firm*—Lyon & Lyon

[57] ABSTRACT

An OHC type internal combustion engine with four valves per cylinder in which a single cam shaft and a single rocker arm shaft are mounted directly above one another and centered above the cylinders. A single rocker arm actuates the pair of exhaust valves of each cylinder and a pair of spaced rocker arms operates the pair of intake valves. The spark plug is mounted in the center of the combustion chamber ceiling and inclined toward the intake valve side to be accessible between the pair of rocker arms. Lubrication to all of the valve actuating components is provided from a main oil passage formed by the tubular rocker arm shaft with ports extending to and nozzles direct at all the relatively moving components.

24 Claims, 3 Drawing Figures

OVERHEAD CAM TYPE VALVE ACTUATING APPARATUS FOR INTERNAL COMBUSTION ENGINE

The present invention relates to an overhead cam ("OHC") type valve actuating apparatus for a four-valve type internal combustion engine having a pair of intake valves and a pair of exhaust valves.

There are various arrangements of valve operating apparatus in a OHC type internal combustion engine, such as, dual cams with each cam positioned over a row of valves for directly actuating those valves or positioned to one side with rocker arms for indirectly actuating those valves, or a single cam with rocker arms for actuating one or both rows of valves indirectly. An arrangement using rocker arms has the advantage of ready access to the valve lifter adjusting devices but a pivotal support, either a rocker shaft or separate supports must be provided for each rocker arm and therefore the number of components required normally increases and the space becomes crowded. This is particularly true of an OHC internal combustion engine having four main valves per cylinder.

Generally, in an internal combustion engine, it is desirable that the electrodes of the spark plug be disposed centrally in the roof of the combustion chamber in order to propagate the combustion flame of the fuel-air mixture induced by the spark discharge of the spark plug throughout the whole area rapidly from the center of the combustion chamber to the marginal portion to thereby prevent knocking and improve the combustion efficiency.

However, as noted above, in conventional OHC type valve actuating devices in four-valve internal combustion engines, the space is very crowded since at least one valve actuating cam shaft is rotatably supported in the cylinder head and separate intake and exhaust rocker arm shafts are fixed of both sides of the valve actuating cam shaft with intake and exhaust rocker arms pivotally mounted on those rocker arm shafts thereby interconnecting the intake and exhaust valve actuating cams on the valve actuating cam shaft and the intake and exhaust valves. Therefore, the space above the central part of the combustion chamber is occupied by a number of valve actuating members leaving no space available for positioning the electrodes of the spark plug centrally in the combustion chamber and for easily installing and removing the spark plug. Consequently, it has heretofore been necessary to dispose the spark plug in a position to one side of the combustion chamber adjacent the valve actuating member. However, the installation and removal of the spark plug is still difficult and the numerous components of the valve actuating device causes the apparatus to become very large.

Moreover, since the OHC valve actuating apparatus includes numerous moving components that must be lubricated such as bearing portions for supporting the rotation of the valve actuating cam shaft, the rocking support portions for the rocker arms, the interengagement between the cams and the rocker arms, and the interengagement between the intake/exhaust valves and the rocker arms, the oil supply system for forcibly supplying oil to those components is extremely important and can become complicated in construction, thus leading to increases in cost. Further, because of the need for an effective oil supply system, the components of the valve actuating mechanism are restricted to some degree in their arrangement and mounting, which is an obstacle to having a more compact valve actuating mechanism.

Thus, it is an object of the present invention to provide a valve actuating apparatus for an internal combustion engine in which the spark plug can be disposed centrally in the combustion chamber and easily installed and removed, and in which the number of components of the valve actuating mechanism is reduced to attain reduction in size and in cost.

A further object of the present invention is to provide a lubricating system for an OHC type valve actuating mechanism in an internal combustion engine of a simple construction and capable of supplying lubricating oil precisely, consistently and forcibly to each portion to be lubricated of the valve actuating mechanism.

The preferred embodiment of the present invention is illustrated in the accompanying drawings, wherein.

Figure 1:
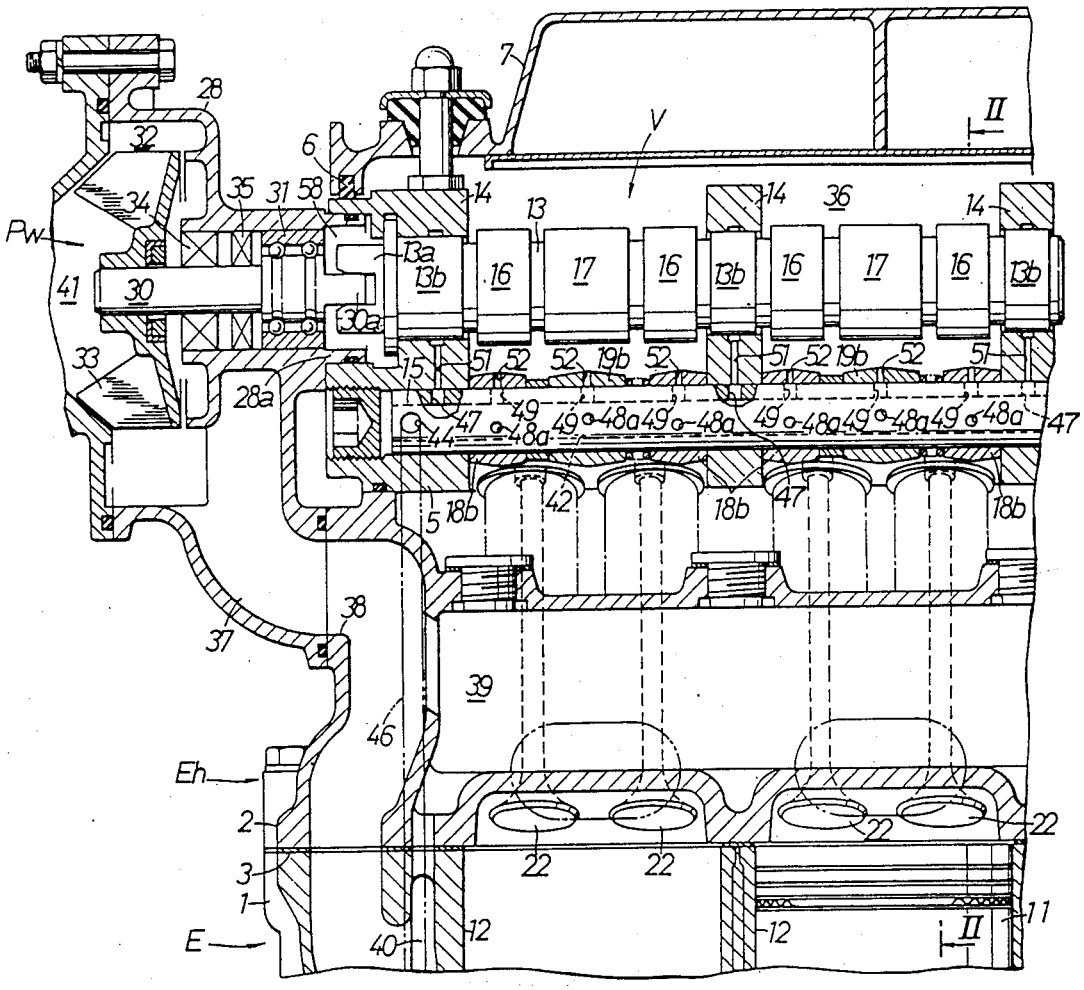
FIG. 1 is a longitudinal sectional elevation of one end of the upper portion of an in-line type internal combustion engine incorporating the present invention and then along the center of the engine.

While the present invention will be described in detail with respect to a specific embodiment thereof in an in-line engine with all the cylinders in a single row rather than a V-type or other type engine, and with specific components of one conventional type, it will readily appear to those skilled in the art that the invention is equally applicable and adaptable to various other engine types and components.

Referring now in detail to the drawings, an internal combustion engine body E for an in-line, OHC engine includes a cylinder block 1 and a cylinder head 2 attached thereto in sealed relation through a gasket 3. A cam case 5 is attached to the top of the cylinder head 2 in sealed relation through a seal member 4. Further, a cover case 7 is attached to the top of the cam case 5 through another seal member 6. The cylinder head 2, the cam case 5 and the cover case 7 constitute a head portion Eh of the engine body E.

In each cylinder 12 in the cylinder block 1 is slidably fitted a piston 11 which is connected to a crankshaft (not shown) in a conventional manner. A single spark plug P and four main valves, two intake and two exhaust, are provided for each cylinder of the engine.

Figure 2:
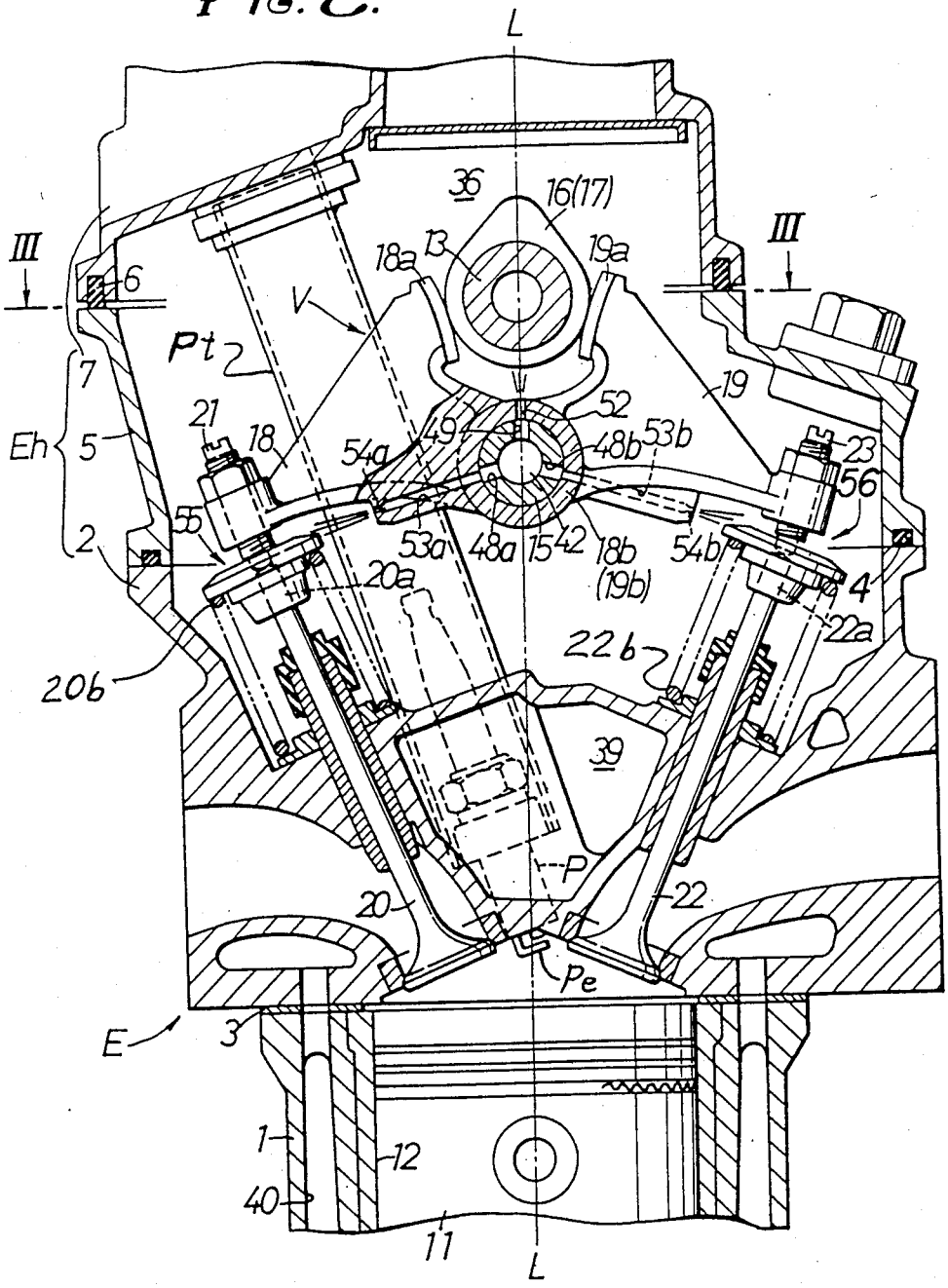
FIG. 2 is a sectional end view of the engine taken substantially on the line II—II in FIG. 1.
Figure 3:
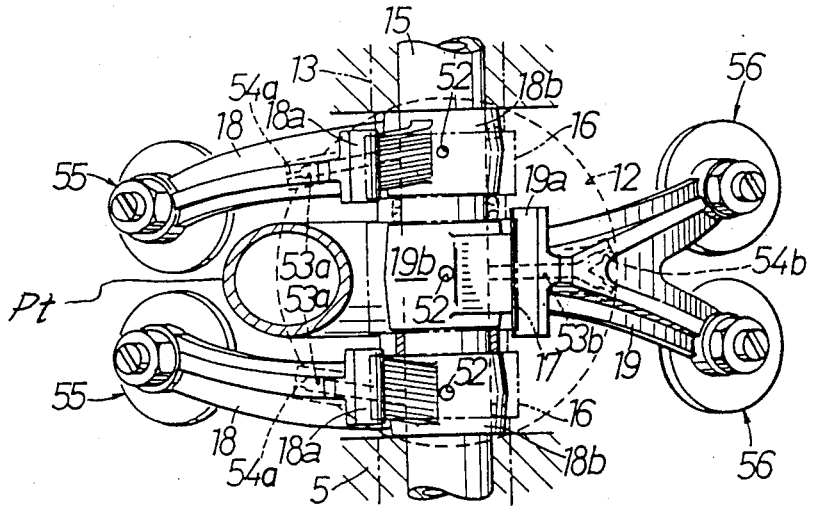
FIG. 3 is a sectional plan view of the engine taken substantially on the Line III—III in FIG. 2.

Within the cam case 5 of the head portion Eh of the engine body E, a valve actuating cam shaft 13 for operating a valve actuating mechanism V is supported rotatably through a plurality of bearings 14, and a rocker arm shaft 15 is fixedly supported in parallel with and immediately below the cam shaft 13. On the valve actuating cam shaft 13 are integrally formed plural sets of intake cams 16 (one pair per cylinder) and exhaust cams 17 (one per cylinder). As shown in FIGS. 2 and 3, the intake and exhaust-side rocker arms 18 and 19, respectively, are pivotably mounted on the rocker arm shaft 15, and a cam slipper 18*a* formed at one end of each intake-side rocker arm 18 is in sliding engagement with the surface of the intake cam 16, while the other end of the intake-side rocker arm 18 is in engagement with the stem end 20*a* of an intake valve 20 through an adjustment screw 21. Further, a cam slipper 19*a* formed at one end of the exhaust-side rocker arm 19 is in sliding engagement with the surface of the exhaust cam 17, while the other end of the exhaust-side rocker arm 19 is in engagement with the stem end 22*a* of an exhaust valve 22 through an adjustment screw 23. In this case, a pair of intake cams 16 actuates the two intake valves 20 per cylinder, while a single exhaust cam 17 actuates both of the exhaust valves 22.

The valve actuating mechanism V operates in the following manner. As the cam shaft 13 rotates, the lobe or crest portion of each of the intake cams 16 comes into engagement with the cam slipper 18*a* of an intake-side rocker arm 18, so that each rocker arm 18 pivots about the rocker arm shaft 15 and forces an intake valve 20 down and open against the closing force of the valve spring 20*b*. And each time the lobe or crest portion of the exhaust cam 17 pushes each exhaust-side rocker arm 19, the rocker arm 19 pivots about the rocker arm shaft 15 and forces a pair of exhaust valves 22 down against the closing force of the valve springs 22*b*.

The valve actuating cam shaft 13 and the rocker arm shaft 15 are used in common for operating all of the intake-and exhaust-side rocker arms 18 and 19, thereby eliminating dual cams and dual rocker arm shafts or special individual rocker arm supports, which greatly simplifies the structure and reduces the weight. The rocker arms 18 and 19 have about the same arm length since the valve actuating cam shaft 13 and the rocker arm shaft 15 are disposed perpendicularly to and centered on the axis L of the cylinder bore 12, and also are about the same weight. Consequently, it is possible to avoid the occurrence of a valve jumping phenomenon during operation at a high speed which can be induced by a higher weight of one rocker arm.

The absence of dual cams and/or dual rocker arm shafts also provides space and access to properly position the spark plug P at the center of the cylinder head. A tube Pt extends between the intake rocker arms from the top of the combustion chamber to the wall of the valve cover 7. For installing or removing the spark plug P an appropriate socket tool is inserted in the space provided by tube Pt to engage the body portion of the spark plug P. In this case, since the tube Pt is disposed among the valve actuating cam shaft 21, rocker arm shaft 22, intake-side rocker arms 26 and intake valves 10 as previously noted, the spark plug 16 can be installed and removed easily without being hindered by those valve actuating members, thus permitting the electrodes Pe to be disposed centrally in the roof of the combustion chamber.

When the fuel-air mixture in the combustion chamber 6 is ignited by spark discharge of the spark plug P at the end of the compression stroke of the engine, the resulting flame spreads from the electrode 16*a* of the spark plug P to the surrounding area. But, since the electrode Pe is disposed approximately on the axis L of the cylinder bore 4 as previously noted, the spacing from the electrode Pe to marginal portions of the combustion chamber are almost equal in length, so that the flame propagates to various portions in a short time, whereby a good combustion free from knocking can be attained.

An extremely important aspect of any valve actuating mechanism is proper lubrication of all the moving components. By the present invention a unique, simple and highly effective lubricating system is provided and combined, in part, with the operation of the engine coolant circulating system. Referring more particularly to FIG. 1, on one end of the valve actuating cam 13 is integrally formed a connection terminal 13*a* which is exposed to one end of the head portion Eh beyond the left-hand as viewed in FIG. 1. To that end of head portion Eh is fixed a pump case 28 of a water pump Pw so as to cover the exposed end of the cam shaft 13, and a bearing cylinder 28*a* in the pump case 28 is fitted in a bearing hole of the bearing 14. Within the bearing cylinder 28*a* of the pump case 28 is mounted a pump shaft 30 rotatably supported by a ball bearing 31, the axis of the pump shaft 30 being in alignment with the axis of the valve actuating cam shaft 13. At the base end of the pump shaft 30 is integrally formed another connection terminal 30*a* which is engageably connected to the connection terminal 13*a* of the valve actuating cam shaft 13 whereby the shaft 13 and the pump shaft 30 are interconnected. To the front end of the pump shaft 13 is fixed an impeller 33 which is located within a pump chamber 32 of the pump case 28 for circulating the engine coolant. On the back side of the impeller 33 a mechanical seal 34 is interposed between the pump shaft 30 and the bearing cylinder 28*a*. Further, an oil seal 35 is interposed between the pump shaft 30 and the bearing cylinder 28*a* in a position between the mechanical seal 34 and the ball bearing 31, whereby the pump chamber 32 and a valve actuating chamber 36 in the head portion Eh of the engine body E are separated in liquid-tight relationship from each other. Upon rotation of the valve actuating cam shaft 13, the water pump Pw is driven directly. A discharge passage 37 formed in the pump case 28 communicates with a coolant inlet 38 formed in the cylinder head 2. The coolant inlet 38 communicates with water coolant jackets 39 and 40 which are formed in the cylinder head 2 and cylinder block 1. A suction port 41 of the water pump Pw is connected to a radiator coolant circuit (not shown) in a conventional manner.

Within the rocker arm shaft 15 is formed a longitudinal main oil supply passage 42 and an oil inlet port 44 is formed in one end (left end in FIG. 1) of the main oil supply passage 42. The oil inlet port 44 communicates with a discharge port of a conventional oil pump (not shown) through an oil supply system 46 formed in the cylinder block 1 and cylinder head 2, whereby the pressurized lubricating oil from the oil pump is introduced into the main oil supply passage 42.

In the outer peripheral wall of the rocker arm shaft 15 are formed first to third axially spaced oil supply ports 47, 48 and 49 and each are provided in plural number along the rocker arm shaft 15 in communication with the main oil supply passage 42. As shown in FIG. 1, the first oil supply ports 47 are in locations corresponding to the plural bearings 14 supporting the valve actuating cam shaft 13, and are in communication with oil passages 51 formed in the bearings 14. The oil passages 51 are each open to the bearing surface of the bearing 14, and the pressurized lubricating oil ejected therefrom lubricates journal portions 13*b* of the valve actuating cam shaft 13.

The second oil supply ports 48*a* and 48*b*, as shown in FIG. 2, are radially open corresponding to rocking support portions 18*b* and 19*b* of the intake- and exhaust-side rocker arms 18 and 19, and lubricate the bearing surfaces of the rocking support portions 18*b* and 19*b*. It should be noted that for convenience and clarity of illustration, the ports 48*a* and 48*b* both are shown in section in FIG. 2 whereas in fact those two ports are axially spaced from each other to correspond to the respective locations of the two separate rocker arms 18 and 19.

The second oil supply ports 48*a* and 48*b* communicate with oil passages 53*a* and 53*b* which are formed within the intake- and exhaust-side rocker arms 18 and 19, as shown in FIG. 2. At the ends of the oil passages 53*a* and 53*b* are formed nozzles 54*a* and 54*b* which are directed at the interengagement points 55 and 56, respectively, between the stem ends 20*a* and 22*a* of the intake and exhaust valves 20, and 22 and the force ends of the intake- and exhaust side rocker arm adjustment screws 21 and 23. The pressurized lubricating oil in the main oil supply passage 42 passes through the second oil supply ports 48*a* and 48*b* and through the nozzles 54*a* and 54*b* of the oil supply passages 53*a* and 53*b* and to be ejected onto the interengagement points 55 and 56 for lubricating those points.

The third oil supply ports 49 axially coincide with the second oil supply ports 48*a* and 48*b* at the bearing or rocking support portions 18*b* and 19*b* of the rocker arms 18 and 19, respectively, and are open upwardly in the same direction as the cylinder axis L—L, namely, toward the intake and exhaust cams 16 and 17 of the valve actuating cam shaft 13, as shown in FIG. 2. The ports 49 coincide intermittently with nozzles 52 formed in the rocking support portions 18*b* and 19*b* as the intake- and exhaust-side rocker arms 18 and 19 in their neutral positions between being pivoted to actuate the valves. The pressurized lubricating oil in the main oil supply passage 42 is ejected toward the intake and exhaust cams 16 and 17 through the third oil supply ports 49 and nozzles 52 to lubricate the contact surfaces between the cam surfaces of the cams 16, 17 and the cam slippers 18*a*, 19*a* of the intake- and exhaust-side rocker arms 18, 19.

In the leftmost bearing 14, as shown in FIG. 1, is formed an oil pump 58 which is in communication with the oil passage 51 and the ball bearing 31 of the water pump Pw, thereby permitting lubrication of the ball bearing 31 with the pressurized lubricating oil stored in the oil pump 58.

The following is a description of the operation of the lubricating system of this embodiment. When the oil pump (not shown) is driven during operation of the engine, the pressurized lubricating oil discharged from the pump passes through the oil supply system 46 and is introduced from the oil inlet port 44 into the main oil supply passage 42 formed in the rocker arm shaft 15. The pressurized lubricating oil thus introduced into the passage 42 then passes through the first, second and third oil supply ports 47, 48 and 49 and lubricates the portions to be lubricated of the valve actuating mechanism V. The lubricating oil ejected from the first oil supply ports 47 passes through the oil passages 51 in the bearings 14 and lubricates the journal portions 13*b* of the valve actuating cam shaft 13. The lubricating oil ejected from the second oil supply ports 48*a* and 48*b* lubricates the bearing surfaces of the rocking support portions 18*b* and 19*b* of the intake-and exhaust-side rocker arms 18 and 19 pivotally supported on the rocker shaft 15, and secondly with rocking motion of the rocker arms 18 and 19 the second oil supply ports 48*a* and 48*b* are brought into communication intermittently with the oil passages 53*a* and 53*b* formed in those rocker arms. The lubricating oil ejected from the nozzles 54*a* and 54*b* at the fore ends of the oil passages 53*a* and 53*b* is directed toward the interengagement points 55 and 56 between the adjustment screws 21 and 23 on the fore ends of the intake- and exhaust-side rocker arms 18 and 19 and the stem ends 20*a* and 22*a* of the intake and exhaust valves 20 and 22. Finally, with the rocking motion of the intake-and exhaust-side rocker arms 18 and 19, the lubricating oil ejected from the third oil supply ports 49 is directed toward the intake and exhaust cams 16 and 17 through the nozzles 52 formed in the rocking support portions 18*b* and 19, and lubricates the contact surfaces between the cams 16 and 17 and the cam slippers 18*a* and 19*a* of the rocker arms 18 and 19.

Thus, according to the present invention in a four valve per cylinder type internal combustion engine the valve actuating cam shaft and the rocker arm shaft are disposed perpendicularly to the axis of and above the cylinder bore and yet the spark plug electrodes can be disposed approximately in the axis of the cylinder bore, namely, at the central part of the ceiling wall of the combustion chamber. Since the space for accommodating the body portion of the spark plug can be formed in the area surrounded by the valve actuating cam shaft, rocker arm shaft, a pair of intake-side rocker arms and a pair of intake valves, it is possible to dispose the spark plug in an optimum position in the combustion chamber, thus permitting the prevention of knocking and a great improvement of the combustion efficiency. Moreover, the spark plug mounting and removing operations can be done easily without being hindered by or requiring the removal of the components of the valve actuating device, thus permitting improvement of maintainability. Further, since the body portion of the spark plug is spaced away from the exhaust side which is seated to high temperatures, it is less thermally affected, thereby permitting proper operation of the spark plug over a long period of time. In addition, since the valve actuating mechanism requires only a single cam shaft and a single rocker arm shaft the construction is greatly simplified and there is a beneficial reduction in size, weight and cost.

Also, according to the present invention of an OHC type valve actuating mechanism of an internal combustion engine, a main oil supply passage which communicates with the discharge of an oil pump is formed within the rocker arm shaft, and in the outer peripheral wall of the rocker arm shaft are formed a plurality of oil supply ports for feeding oil to the bearings of the valve actuating cam shaft, to the rocking support portions intake- and exhaust-side rocker arms, to the connections between the intake- and exhaust-side rocker arms and the stem ends of the intake and exhaust valves, and further to the contact surfaces between the intake and exhaust cams on the valve actuating cam shaft and the cam slippers of the intake and exhaust-side rocker arms. Consequently, the desired amount of lubricating oil can be distributed forcibly from the single main oil supply passage in the rocker arm shaft to each portion to be lubricated of the entire valve actuating mechanism, whereby the overall length of the oil supply system of the actuating valve mechanism is minimized and the entire construction of the said oil supply system is simplified. The oil supply efficiency is enhanced by reducing the flow resistance of the lubricating oil. Further, since the components of the valve actuating mechanism are not restricted in their layout and mounting by the oil supply system, it is possible to attain reduction in size of the valve actuating mechanism and provide flexibility in designing its components and their locations as noted above.

The invention claimed is:

1. In an OHC valve actuating apparatus of an internal combustion engine having plural cylinders in one line and valves on each side of that line of cylinders, the combination of, a single cam shaft rotatable mounted and centered above the line of cylinders, single rocker shaft mounted and centered above the line of cylinders, and a plurality of rocker arms pivotally mounted on said rocker shaft, said rocker shaft being mounted between the cylinders and said cam shaft, each rocker arm having means for engaging said cam shaft for causing pivoting of said rocker arm and means for engaging a valve for causing opening of that valve upon said pivoting, means being provided for mounting a spark plug above and substantially centered in each cylinder, said spark plug mounting means being inclined to one side a minimum amount sufficient to clear said cam shaft and said rocker shaft.

2. The apparatus of claim 1 wherein the center lines of the plural cylinders intersect the center lines of said cam shaft and said rocker shaft.

3. The apparatus of claim 1 wherein each cylinder is provided with a pair of intake valves on one side and a pair of exhaust valves on the other side.

4. The apparatus of claim 3 wherein one pair of said valves is engaged and actuated by a single rocker arm having a single said means for engaging said cam shaft.

5. The apparatus of claim 4 wherein said single said means for engaging said cam shaft is longitudinally centered relative to that cylinder.

6. The apparatus of claim 5 wherein a pair of said rocker arms is provided for actuating the other said pair of valves, and said pair of rocker arms engage said cam shaft on either side of said single said means for engaging said cam shaft.

7. The apparatus of claim 6 wherein said single said means for engaging said cam shaft is on the rocker arm for actuating the engine exhaust valve.

8. The apparatus of claim 3 wherein each said valve has a centerline lying in a plane perpendicular to the axis of the rocker shaft.

9. The apparatus of claim 8 wherein each said valve centerline is inclined relative to and away from a plane through the centerline of the plural cylinders.

10. The apparatus of claim 3 wherein a pair of said valves is engaged and actuated by a pair of rocker arms and said spark plug mounting means extends between that said pair of rocker arms.

11. The apparatus of claim 1 wherein each said means for engaging a valve is adjustable.

12. The apparatus of claim 1 wherein said rocker shaft is provided with a longitudinal main passage means for receiving lubricating oil from the engine oil pump, and port means in said rocker shaft for communicating the lubricating oil to said rocker arms for lubricating the said pivotal mounting of said rocker arms on said rocker shaft.

13. The apparatus of claim 1 wherein said rocker shaft is provided with a longitudinal main passage means for receiving lubricating oil from the engine oil pump, and port means in said rocker shaft for communicating the lubricating oil to said cam shaft for lubricating the said rotatable mounting thereof.

14. The apparatus of claim 1 wherein said rocker shaft is provided with a longitudinal main passage means for receiving lubricating oil from the engine oil pump, and port means in said rocker shaft for communicating the lubricating oil to said cam shaft to lubricate the cam shaft at said engagements by said rocker arms.

15. The apparatus of claim 14 wherein said port means includes a port in said rocker shaft at the location of the pivotal support of each rocker arm, and a nozzle in said rocker arm adjacent said port for ejecting lubricating oil onto said cam shaft.

16. The apparatus of claim 1 wherein said rocker shaft is provided with a longitudinal main passage means for receiving lubricating oil from the engine oil pump, and port means in said rocker shaft for communicating the lubricating oil to each said rocker arm, passage means in each said rocker arm for communicating the lubricating oil to the said means for engaging the valve for lubricating that interengagement.

17. The apparatus of claim 16 wherein said passage means includes a nozzle portion for ejecting the lubricating oil onto the point of interengagement.

18. The apparatus of claim 1 wherein said rocker shaft is provided with a longitudinal main passage means for receiving lubricating oil from the engine oil pump, and port means in said rocker shaft for communicating the lubricating oil to said cam shaft both at the said rotatable mounting thereof and at the engagement with the rocker arms and to said rocker arms both at the said pivotal mountings thereof and at said means for engaging the valves.

19. The apparatus of claim 18 wherein each cylinder is provided with a pair of intake valves on one side and a pair of exhaust valves on the other side, and one said pair of valves is actuated by a single rocker arm and the other said pair of valves is actuated by a pair of rocker arms.

20. The apparatus of claim 19 wherein means are provided for mounting a spark plug above and substantially centered in each cylinder, said spark plug mounting means being inclined to one side an amount sufficient to clear said cam shaft and said rocker shaft.

21. The apparatus of claim 20 wherein said spark plug mount means is positioned between said pair of rocker arms actuating the pair of valves for that cylinder.

22. In an OHC valve actuating apparatus for a four-valve type internal combustion engine incuding a cylinder block, a cylinder head fixed onto the cylinder block, a plurality of cylinder bores in the cylinder block with a piston slidably fitted in each cylinder bore, a pair of intake valve disposed in one half portion of a sealing wall of the combustion chamber, and a pair of exhaust valves disposed in the other half portion of the ceiling wall, the improvement comprising, a valve actuating cam shaft and a rocker arm shaft disposed between the cylinder head and said cam shaft perpendicular to the axis of each cylinder bore; an exhaust cam for actuating the pair of exhaust valves and intake cams for actuating the paired intake valves integrally formed on the valve actuating cam shaft so that the intake cams are disposed on both sides of the exhaust cam; and exhaust-side rocker arm interconnecnting the paired exhaust valves and the exhaust cam, and intake-side rocker arms interconnecting the paired intake valves and the intake cam on both sides of the exhaust-side rocker arm; said rocker arms each pivotably mounted on the rocker arm shaft; an electrode of a spark plug mounted in the cylinder head is disposed in a central part of the ceiling wall of the combustion chamber; and a tube for receiving the spark plug positioned among the valve actuating cam shaft, the rocker arm shaft, the pair of intake-side rocker arms and the pair of intake valves.

23. A valve actuating device in an internal combustion engine as set forth in claim 22, wherein the exhaust-side rocker arm is provided at one end thereof with a cam slipper which is in abutment with the exhaust cam while at the other end thereof are formed bifurcated branch arms engaging the stem ends of the paired exhaust valves.

24. An OHC type valve actuating mechanism for an internal combustion engine, including, a rocker arm shaft and a valve actuating cam shaft mounted above said rocker arm shaft, said valve actuating cam shaft and said rocker arm shaft being in parallel relationship to one another, intake-side rocker arms and exhaust-side rocker arms rockably supported by the rocker arm shaft, intake and exhaust cams formed on the valve actuating cam shaft, the intake and exhaust cams and intake and exhaust valves being interconnected through the intake-side and exhaust-side rocker arms, respectively, means for mounting a spark plug above and substantially centered in each cylinder of the internal combustion engine, said spark plug mounting means being inclined to one side an amount sufficient to clear said cam shaft and said rocker arm shaft, a lubricating system having a main oil supply passage formed within the rocker arm shaft and in communication with a supply of oil, said rocker arm shaft having an outer peripheral wall formed with first oil supply ports for supplying oil to the valve actuating cam shaft, second oil supply ports for supplying oil to the intake-side and exhaust-side rocker arms and also to the connections between the intake-side and exhaust-side rocker arms and stem ends of the intake and exhaust valves, and third oil supply ports for supplying oil to contact surfaces between the intake and exhaust cams on the valve actuating cam shaft and the intake-side and exhaust-side rocker arms.

* * * * *